US005096569A

United States Patent [19]

Maa et al.

[11] Patent Number: 5,096,569

[45] Date of Patent: Mar. 17, 1992

[54] CATALYTIC HYDROPYROLYSIS OF CARBONACEOUS MATERIAL WITH CHAR RECYCLE

[75] Inventors: Peter S. Maa, Baton Rouge, La.; Russell R. Chianelli, Somerville, N.J.

[73] Assignee: Exxon Research and Engineering Company, Florham Park, N.J.

[21] Appl. No.: 641,328

[22] Filed: Jan. 15, 1991

Related U.S. Application Data

[63] Continuation of Ser. No. 485,410, Feb. 27, 1990, abandoned, which is a continuation of Ser. No. 376,464, Jul. 3, 1989, abandoned, which is a continuation of Ser. No. 122,388, Nov. 19, 1987, abandoned.

[51] Int. Cl.[5] ..... C10G 1/06; C10G 1/08

[52] U.S. Cl. ..... 208/413; 208/417; 208/421; 208/422; 208/423

[58] Field of Search ..... 208/408, 411, 412, 413, 208/417, 421, 422, 427, 432, 111, 423

[56] References Cited

U.S. PATENT DOCUMENTS

| | | | |
|---|---|---|---|
| 4,166,786 | 9/1979 | Duraiswamy et al. | 208/414 |
| 4,172,814 | 10/1979 | Moll et al. | 208/420 |
| 4,519,895 | 5/1985 | Deschamps et al. | 208/413 |
| 4,544,478 | 10/1985 | Kelley | 208/427 |
| 4,648,965 | 3/1987 | McMath et al. | 208/427 |

*Primary Examiner*—Asok Pal
*Assistant Examiner*—Nhat Phan
*Attorney, Agent, or Firm*—Richard E. Nanfeldt; Joseph J. Dvorak

[57] ABSTRACT

Disclosed is a method for catalytically hydropyrolyzing carbonaceous material to produce liquid products boiling under about 550° C. with reduced amounts of methane being formed. The process comprises (a) treating the carbonaceous material with as hydrogenation catalyst; (b) contacting the so-treated carbonaceous material with an effective amount of hydrogen, at an effective residence time, at a temperature below the critical temperature of rapid methane formation; (c) recovering the resulting liquids, gases, and char; and (d) recycling the char.

11 Claims, 3 Drawing Sheets

CATALYTIC HYDROPYROLYSIS OF CARBONACEOUS MATERIAL WITH CHAR RECYCLE

This application is a continuation of application Ser. No. 485,410, filed Feb. 27, 1990, now abandoned, which is a continuation application of U.S. Ser. No. 376,464, filed July 3, 1989, now abandoned, which in turn is a Rule 60 continuation of U.S. Ser. No. 122,388, filed Nov. 19, 1987, now abandoned.

FIELD OF THE INVENTION

The present invention relates to a catalytic hydropyrolysis process for converting normally solid carbonaceous material, such as coal, to predominantly liquid products boiling under 550° C. while producing relatively low levels of methane and consuming relatively low levels of hydrogen. The process comprises contacting the carbonaceous material which has previously been treated with a catalyst, for an effective solids residence time, with an effective amount of hydrogen, at a temperature below the critical temperature threshold of rapid methane formation. The resulting char, which contains relatively high levels of catalyst in an active form, is recycled to the hydropyrolysis reactor.

BACKGROUND OF THE INVENTION

Because of the uncertainty of petroleum supplies over the last decade, work is still being done to obtain useful liquids and gases from normally solid carbonaceous materials, such as coal and oil-shale. Coal, once the nation's leading source of energy, is perceived by many as a bridge between the finite supply of petroleum and the potentially inexhaustible energy sources such as solar and nuclear fusion.

Examples of processes developed for obtaining useful liquids and gases from carbonaceous materials, such as coal and oil-shale, include liquefaction processes, with and without a hydrogen donor solvent, gasification, pyrolysis with an inert solvent and hydrogen, and retorting in the case of oil-shale. The present invention is concerned with catalytic hydropyrolysis. Hydropyrolysis is conventionally practiced by pyrolyzing coal at temperatures from about 500° C. to about 1000° C. in the presence of hydrogen. Conventional catalytic hydropyrolysis processes suffer from such disadvantages as relatively high hydrogen consumption, the production of undesirable amounts of methane, and liquid products having relatively high boiling ranges, for example greater than 550° C. Consequently, there exists a need in the art for catalytic hydropyrolysis processes which can avoid, or substantially reduce, such disadvantages.

SUMMARY OF THE INVENTION

In accordance with the present invention, there is provided a method for catalytically hydropyrolyzing carbonaceous material to produce liquid products boiling under about 550° C. with reduced amounts of methane being formed. The process comprises: (a) treating the carbonaceous material with a hydrogenation catalyst selected from one or more metals from Groups IVA, VA, IIB, IVB, VB, VIB, VIIB, and VIII of the Periodic Table of the Elements; (b) contacting the so treated carbonaceous material with an effective amount of hydrogen, at an effective residence time, at a temperature below the critical temperature of rapid methane formation; (c) recovering the resulting liquids, gases, and char; and (d) recycling the char.

In preferred embodiments of the present invention the carbonaceous material is coal and at least about 5 wt. % of hydrogen, based on the weight of coal, at a partial pressure of about 300 psig to about 1200 psig, is provided.

In another preferred embodiments of the present invention, the hydropyrolysis process is conducted in two stages with char being recycled to any one or both of the stages. The first stage is at a temperature from about 350° C. to about 400° C. and the second stage is at a temperature from about 400° C. to about 480° C.

In yet other preferred embodiments of the present invention, the catalysts employed is an oil-soluble molybdenum catalyst present in about 50 ppm to 1000 ppm metal, based on the weight of carbonaceous material.

DETAILED DESCRIPTION OF THE INVENTION

Figure 1:
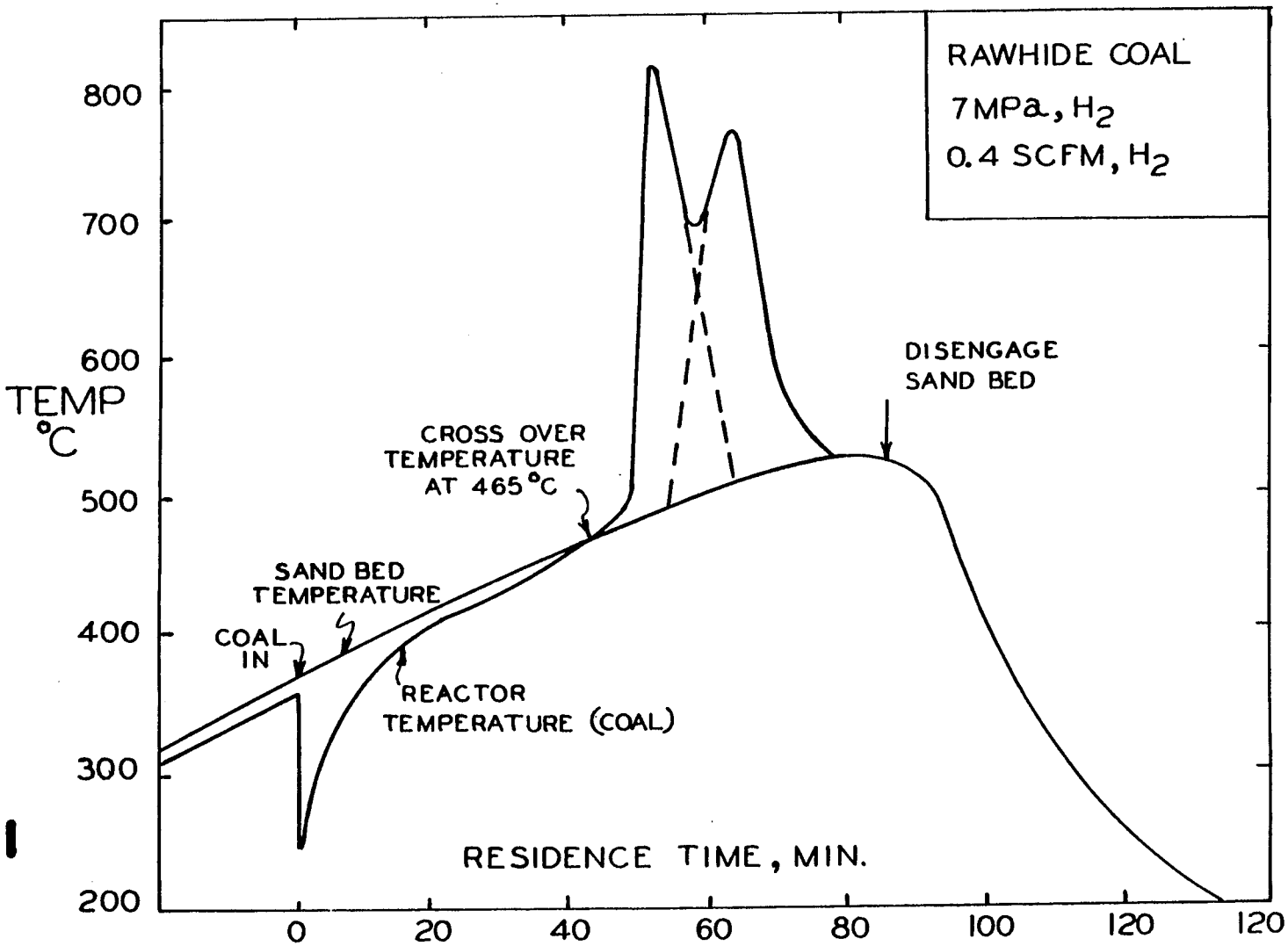
FIG. 1 is a plot illustrating how the critical temperature at which methane begins to rapidly form can be determined for any given carbonaceous material (in this particular case Rawhide coal), and set of conditions.

Carbonaceous materials on which the present invention may be practiced are those naturally occurring solid carbonaceous materials selected from the group consisting of coal, peat, and oil-shale. Non-limiting examples of coals which may be treated herein include lignite, subbituminous, examples of which include Rawhide and Wyodak, and bituminous, such as Illinois No. 6 and Monterey No. 1. The preferred carbonaceous material for the practice of the present invention is coal.

It is preferred that the carbonaceous material have as high a surface area as possible, although, it is not economically justifiable to pulverize the material to a very fine powder. That is, it is desirable to expose as much of the carbonaceous material surface area as possible without losing it as dust or fines, or as the economics of material grinding or process equipment dictate. Generally, the carbonaceous material, such as coal, will be crushed and ground to a relatively small size and will contain a majority of particles less than about 4 mesh U.S. Sieve Size.

Catalysts employed in the practice of this invention are any of the unsupported hydrogenation catalysts solvents and which contain at least one metal from Groups IVA, VA, IIB, IVB, VB, VIB, VIIB, and VIII of the Periodic Table of the Elements as illustrated on the last page of *Advanced Inorganic Chemistry,* by Cotton and Wilkinson, 4th Edition, John Wiley Interscience, 1980. Preferred metals include Sn, Mo, Ni, Co, Fe, and Zn, more preferred are Mo, Ni, and Fe, and most preferred is Mo. The term dispersible means that the catalyst composition, when added to water or an organic solvent, is capable of forming a substantially stable suspension.

The carbonaceous material can be treated with the catalyst by any appropriate means. In the case of lignite and coal, such means include soaking it in a solution, or a dispersion, containing the catalyst, followed by drying at a temperature from about 100° C. to about 110° C.

An alternative method to conventional and soaking techniques would be to dissolve an oil-soluble catalyst in a 400° F.+ hydropyrolysis derived oil faction. The oil containing the dissolved catalyst, can then be sprayed onto the carbonaceous material. Such a method would avoid the wet incipient, or slurry impregnation methods for introducing fresh catalyst.

It is also within the scope of this invention to dissolve a water soluble catalyst in a small amount of water then mix the resulting solution with the 400° F.+ oil-faction to form an emulsion. The emulsion is then sprayed onto the surface of the carbonaceous material. In either case, the carbonaceous material can be sprayed with the catalyst solution, or emulsion, either before it is introduced into the pyrolysis reactor, or while it is in the pyrolysis reactor.

The amount of catalyst which can be used in the practice of the present invention will generally range from, based on the aforesaid metal, of about 50 ppm to about 5000 ppm, preferably about 100 ppm to about 1000 ppm, based on the amount of carbonaceous material.

The process of the present invention may be practiced in any one or more suitable pyrolysis reactors. Non-limiting examples of such reactors include moving bed and fluidized bed reactors. Preferred are fluidized bed reactors, but if moving bed reactors are employed, those of transverse flow design are preferred. One or more reactors may be employed herein, especially when the process is conducted in two or more stages. It is preferred to use two stages. In the first stage, the carbonaceous material containing catalyst is fed into a first pyrolysis reactor maintained at a temperature from about 350° C. to 400° C. by an effective amount of preheated hydrogen-containing recycle gas, and optionally recycle char. In the second stage, the carbonaceous material is transferred from the first pyrolysis reactor to a second pyrolysis reactor which is maintained at a temperature from the temperature of the first reactor to about 500° C. with the criteria that the second pyrolysis reactor be at a temperature at least about 20° C., preferably 40° C., higher than the first pyrolysis reactor. The temperature of the second reactor is maintained at the desired temperature by preheated hydrogen-containing recycle effluent and optionally recycle char.

Solids residence times employed herein will be to some extent dependent on the number of stages of the process. For example, if a single stage is used, then the solids residence time will be from about 20 to about 90 minutes, preferably about 30 to 60 minutes, and more preferably about 40 to 50 minutes. If more than one stage is used, then the solids residence time of the first stage will be from about 15 to 90 minutes, preferably from about 30 to 40 minutes, and each subsequent stage will have a solids residence time from about 15 to 90 minutes, preferably from about 30 to 50 minutes.

The term, effective amount of hydrogen, as used herein, means that minimum amount of hydrogen which is needed for the hydrogenation reactions hereof, plus the minimum amount of hydrogen needed to heat the reactors and to fluidize the beds when fluidized bed reactors are used. Generally, for purposes of this invention, the amount of hydrogen used will be at least about 5 wt. %, based on the weight of carbonaceous material, at a partial pressure of about 300 to 1200 psig, preferably about 500 psig to 1000 psig. Relatively little hydrogen is consumed in the practice of the present invention when compared with more conventional catalytic hydropyrolysis processes. For example, as little as 75%, even at little as 50% or less of hydrogen is consumed, when compared with conventional processes.

The reason why such small amounts of hydrogen are consumed in the practice of the present invention is because relatively small amounts of methane are produced. In more conventional hydropyrolysis processes, relatively large amounts, usually from about 10 wt. % to about 30 wt. % of methane is produced, based on the total weight of products. The production of methane during hydropyrolysis consumes hydrogen, consequently, it is desirable to keep the production of methane at a minimum.

In the practice of the present invention, methane formation is kept at a minimum by keeping the pyrolysis temperature below the critical temperature at which methane begins to rapidly form. This critical temperature is dependent on such parameters as hydrogen partial pressure, hydrogen flow rate, and the particular catalyst employed. The following example will illustrate how the critical temperature can be determined for any carbonaceous material and hydrogen treat rate.

METHOD OF DETERMINING CRITICAL TEMPERATURE

Although coal and a hydrogen flow of 0.4 SCFM were employed in this example, the example can be followed for any carbonaceous material and hydrogen treat rate.

The apparatus used in this example was a fixed bed hydropyrolysis unit primarily comprised of a gas manifold, coal hopper, pyrolysis reactor and fluidized sand bath.

Figure 2:
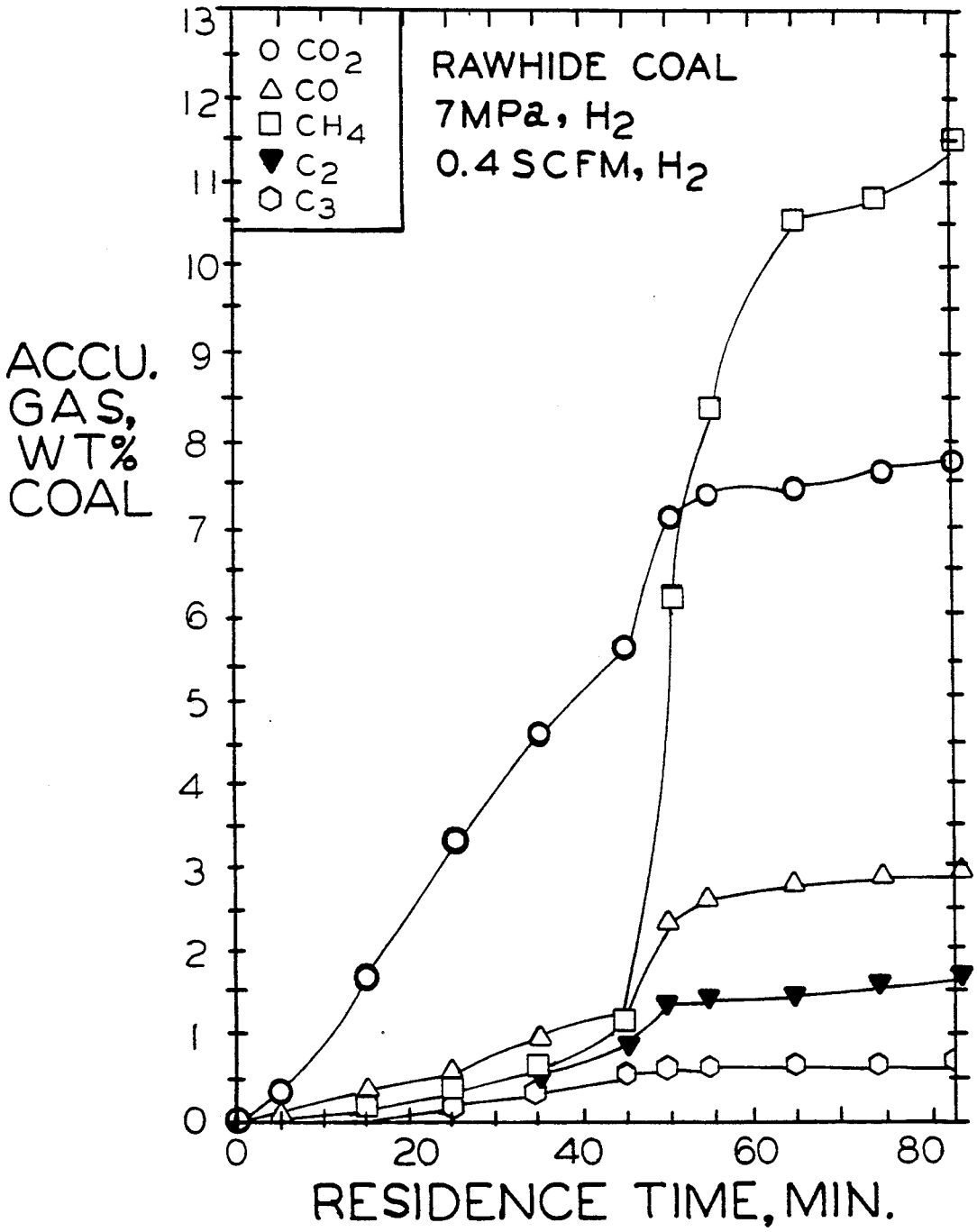
FIG. 2 is a plot of gaseous products produced in accordance with Example 1 wherein Rawhide coal was hydropyrolyzed over a temperature range which exceeds the critical temperature at which methane begins to rapidly form.
Figure 3:
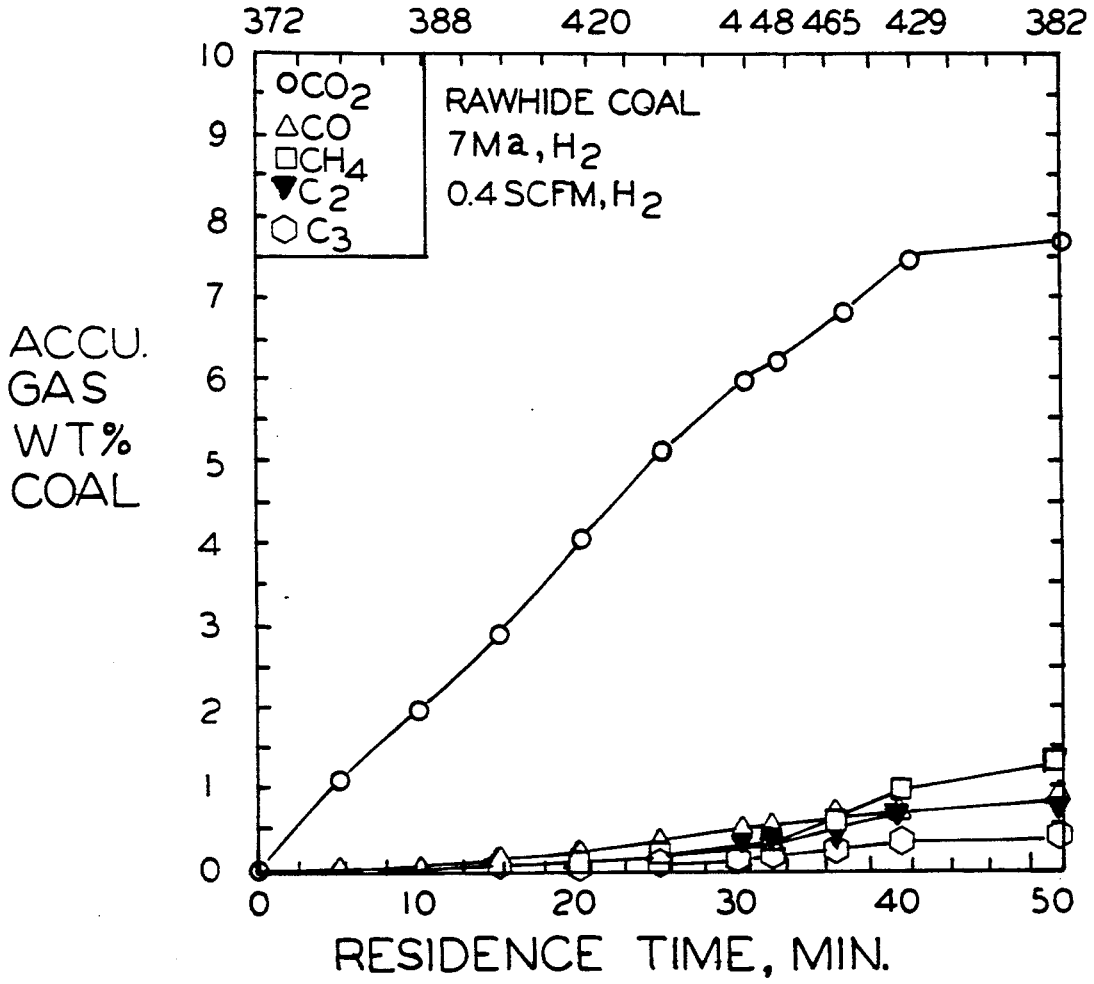
FIG. 3, in contrast to FIG. 1, is a plot of gaseous products obtained in accordance with Example 2 hereof when Rawhide coal was hydropyrolyzed at temperatures below the critical temperature of rapid methane formation.

400 g of Rawhide coal was charged into the hopper and the reactor was placed into the fluidized sand bath and heated to a temperature of 525° C. at a heating rate of 2.2° C. per minute with preheated hydrogen flowing at a rate of 0.4 SCFM throughout. The coal from the hopper was charged into the reactor when the reactor reached 360° C., with the sand bath continuing to be heated at the rate of 2.2° C. per minute, the temperature of the reactor dropped dramatically at first because of the introduction of the relatively cold coal, but recovered to the temperature. The temperature of the sand bath and the reactor were independently recorded and plotted, which plot is shown in FIG. 1 hereof. The temperature at which the temperature of the reactor becomes greater than that of the sand bath is the critical temperature threshold. It is this critical temperature threshold, if exceeded during the hydropyrolysis reaction, which causes rapid formation of methane with increased hydrogen consumption. This is shown in FIG. 2 hereof. Consequently, it is essential that the hydropyrolysis process of the present invention be conducted below this critical temperature threshold.

Char resulting from typical catalyzed hydropyrolysis processes is unsuitable for recycling because it usually absorbs an undesirable amount of liquids owing to the higher pyrolysis temperatures employed. Furthermore, it generally contains catalyst species which are not very reactive, thereby making it uneconomical and detrimental for recycling. Surprisingly, char resulting from the practice of the present invention is of such a nature that it is suitable for recycling with advantageous results. For example, the char of the present invention is not so porous that it will absorb undesirable amounts of liquids. Also, because of the relatively low hydropyrolysis temperatures used in the practice of the present invention, the char contains catalyst species in a form which is still active.

In the practice of the present invention, if more than one reactor is employed, the char may be recycled to any one or all of the reactors as long as the total char recycled is such that it will remain the catalyst concentration at a desired level, for example 1000 ppm on feed.

The following examples serve to more fully describe the manner of practicing the above-described invention, as well as to set forth the best modes contemplated for carrying out various aspects of the invention. It is understood that these examples in no way serve to limit the true scope of this invention, but rather, are presented for illustrated purposes.

EXAMPLE 1

Comparative

A fixed fed hydropyrolysis reactor was enclosed in a fluidized sand bath and heated with a flow of 0.4 SCFM of preheated hydrogen gas at a pressure of 7 MPa to a temperature of 525° C. at a rate of 2.2° C. per minute. When the reactor reached a temperature of 370° C., 400 grams of dried Rawhide coal was charged into it and volatile products which resulted were carried by the gas into a high pressure knockout, which was cooled to 0° C. by a glycol cooling system. The gas pressure was then reduced to atmospheric pressure and passed through a low pressure knockout, which is also cooled to 0° C. by a glycol system. The gas from the low pressure knockout was measured by a wet-test meter sampled every 5 minutes into an aluminum bag. At the end of the run the reactor temperature was 525° C., and the sand bath temperature was lowered to facilitate the cooling of the char in the reactor. The resulting gases, liquids, and char, were collected and analyzed. The gas evolution with time was plotted and is shown in FIG. 1 hereof. This figure shows that methane formation is rapid at temperatures above about 475° C. but below this temperature methane formation was only 1.5 wt. %. Although coal and a hydrogen flow of 0.4 SCFM were employed in the example, the example can be followed for any carbonaceous material and hydrogen treat rate for determining the critical temperature threshold. The temperature profile of this experiment is shown in FIG. 4 thereof.

The yields obtained from this experiment are:

| Yields, Wt. % Coal | |
|---|---|
| CH4 | 11.9 |
| $C_2 + C_3$ | 2.4 |
| $CO_x$ | 11.0 |
| Oil | 14.7 |
| $H_2O$ | 10.5 |
| Char | 44.6 |
| $H_2$ Consumption, Wt. % Coal | 3.76 |

EXAMPLE 2

The procedure of the above example was followed except that the experiment was stopped at 35 minutes after the coal was charged into the reactor. This corresponded to about 8.2 wt. % hydrogen treat rate based on the weight of coal with the maximum temperature being about 465° C. The temperature profile of this experiment is shown in FIG. 5 hereof and the gas evolution was plotted with time and is shown in FIG. 2 hereof. The yields obtained from this experiment are:

| Yields, Wt. % Coal | |
|---|---|
| CH4 | 1.4 |
| $C_2 + C_3$ | 1.2 |
| $CO_x$ | 9.6 |
| Oil | 14.3 |
| $H_2O$ | 10.8 |
| Char | 61.5 |
| $H_2$ Consumption, Wt. % Coal | 0.64 |

EXAMPLE 3

300 g of Rawhide coal was blended with 120 gm of char containing about 2000 ppm of molybdenum metal based on the amount of char. The char was produced by hydropyrolyzing Rawhide coal which was first soaked in a toluene solution containing $[CH_3N(C_8H_{17})_2MoS_4$ so as to provide about 1000 ppm of molybdenum metal based on the weight of coal. The mixture of coal and char gave about 800 ppm molybdenum based on the weight of coal and about 571 ppm based on the weight of the coal/char mixture. A simulated two-stage hydropyrolysis process was carried out in a fixed bed hydropyrolysis reactor. The first stage was operated at a temperature of 370° C. at a solids residence time of 30 minutes. The second stage was carried out at a temperature 455° C. at a solids residence time of 25 minutes. The hydrogen pressure for both stages was 1000 psig with a hydrogen flow rate of 0.8 SCFM at 25° C.

The resulting yields of gaseous, liquid, and solid products were determined and the results are shown in Table I below.

EXAMPLE 4

Comparative

The procedure of the above example was followed except the char used did not contain a catalyst. Again, the yields of the resulting products were determined and the results are also shown in Table I below.

TABLE I

| Yields, Wt. % Coal | Example 3 | Example 4 |
|---|---|---|
| $CH_4$ | 3.7 | 4.2 |
| $C_2$ | 1.0 | 0.9 |
| $C_3$ | 0.8 | 0.5 |
| $CO_x$ | 8.0 | 7.8 |
| $H_2O$ | 11.6 | 10.7 |
| Oils | 18.7 | 14.7 |
| Char | 58.6 | 63.3 |

The above examples illustrate that higher yields of oils result when a char, containing active catalyst species, is recycled in the hydropyrolysis process of the present invention.

What is claimed is:

1. A catalytic hydropyrolysis method for minimizing methane formation while producing liquid products boiling at a temperature less than about 550° C. from carbonaceous material selected from the group consisting of coal, peat and oil shale, which method comprises:

(a) treating the carbonaceous material with a hydrogenation catalyst containing a metal selected from the group consisting of Groups IVA, VA, IIB, IVB, VB, VIB, VIIB, and VIII of the Periodic Table of the Elements in an amount sufficient to provide about 50 ppm to about 5000 ppm of metal based on the amount of carbonaceous material;

(b) contacting the so-treated carbonaceous material with at least 5.0 wt. % of hydrogen based upon weight of said carbonaceous material, at a residence time of about 30 to about 90 minutes, at a temperature in the range of about 350° C. to a temperature below critical threshold temperature for methane formation to form liquids, gases, and char and to minimize the amount of methane formed;

(c) recovering the resulting liquids, gases, and char; and (d) recycling the char to Step (b) only in amount which maintains the metal in the range of about 50 ppm to about 5000 ppm based on the amount of carbonaceous material.

2. The method of claim 1 wherein the critical threshold temperature is about 465° C.

3. The method of claim 2 wherein the carbonaceous material is coal.

4. The method of claim 3 wherein the hydrogenation catalyst contains at least one metal selected from the group consisting of Sn, Mo, Ni, Co, Fe, and Zn.

5. The method of claim 4 wherein the metal is selected from the group consisting of Mo, Ni, and Fe.

6. The method of claim 5 wherein the metal is Mo.

7. The method of claim 4 wherein at least 5 wt. % hydrogen is used, based on the weight of coal, at a hydrogen partial pressure of about 300 psig to about 1200 psig.

8. The method of claim 7 wherein Step (b) is conducted in more than one stage, each stage at increased severity.

9. The method of claim 7 wherein about 100 ppm to 1000 ppm metal is present.

10. The method of claim 7 wherein Step (b) is conducted in two stages and wherein the temperature in the first stage is in the range of about 350° C. to about 400° C. and the temperature in the second stage is from about 20° C. to about 40° C. higher than the temperature in the first stage.

11. The method of claim 4 wherein the hydrogenation catalyst is oil-soluble and is dissolved in a hydropyrolysis derived oil which boils above 400° C., then sprayed onto the carbonaceous material.

* * * * *